United States Patent [19]

Hauber et al.

[11] Patent Number: 5,064,113

[45] Date of Patent: Nov. 12, 1991

[54] CARTON

[75] Inventors: David E. Hauber; Monica Jacobs; W. Richard Davis, all of Winston-Salem, N.C.; Tom Rushing, Denville; Robert A. Fanara, Lawrenceville, both of N.J; Gilbert L. Horton, Kernersville, N.C.; Richard M. Porter, Hartsville, S.C.

[73] Assignee: Sara Lee Corporation, Winston-Salem, N.C.

[21] Appl. No.: 696,109

[22] Filed: May 6, 1991

[51] Int. Cl.[5] ..... B65D 5/02

[52] U.S. Cl. ..... 229/8; 229/132; 9/431; 9/433

[58] Field of Search ..... 229/8, 132, 137; D9/430–433

[56] References Cited

U.S. PATENT DOCUMENTS

| | | | |
|---|---|---|---|
| D. 109,048 | 3/1938 | Brogden | D9/431 |
| 964,556 | 7/1910 | Rogers . | |
| 2,067,998 | 1/1937 | Williamson | 229/8 |
| 2,345,646 | 4/1944 | Williamson | 229/8 |
| 2,361,923 | 11/1944 | Arneson . | |
| 2,382,368 | 8/1945 | Mitchell, Jr. | 229/8 |
| 2,396,010 | 3/1946 | Isenberg et al. | 229/8 |
| 2,437,110 | 3/1948 | Marler . | |
| 2,894,673 | 7/1959 | Vuillemenot . | |
| 3,142,430 | 7/1964 | Meyers . | |
| 3,222,190 | 12/1965 | Davis . | |
| 3,302,845 | 2/1967 | Gould | 229/8 |

FOREIGN PATENT DOCUMENTS

| | | | |
|---|---|---|---|
| 85166 | 5/1965 | France | 229/8 |
| 2409917 | 7/1979 | France | 229/8 |
| 2448432 | 10/1980 | France | 229/8 |
| 262141 | 9/1949 | Switzerland | 229/8 |

*Primary Examiner*—Gary E. Elkins

*Attorney, Agent, or Firm*—Charles Y. Lackey; William S. Burden

[57] ABSTRACT

A hollow container or carton for an article formed of a single blank which has been suitably shaped and provided with selected fold lines. The carton is provided with a bottom structure which may readily snap open to provide access to the carton. The uppermost edges of both the carton front panel and the rear panel define parabolic curves and the carton side panels include tabs having curved outer edge portions conforming to the uppermost edges of the front and rear panels for alignment therewith and securement thereto.

14 Claims, 3 Drawing Sheets

CARTON

This invention relates to a packaging container or carton for various articles of merchandise, and has particular application to the merchandising of hosiery, pantyhose and other articles of apparel.

BACKGROUND OF THE INVENTION

It is well known to form various types of packages from material such as paperboard, plastic, and the like and display such packages on merchandising racks. U.S. Pat. No. 4,531,646, for example, discloses a product display rack having a series of vertically spaced tray assemblies provided with dividers for defining a series of channels for displaying discrete packages such as, for example, egg-shaped packages of the general type disclosed in U.S. Pat. Nos. 3,741,379 and 3,924,736.

SUMMARY OF THE INVENTION

The concept of the present invention is to provide a flat sheet of paperboard or other suitable sheet material selectively shaped and provided with suitable fold lines which may be folded along the score or fold lines to form a carton or package having a frontal view similar to the egg-shaped container of U.S. Pat. Nos. 3,741,379 and 3,924,736.

The package is formed from a single blank shaped and folded in such a manner so that the entire outer surfaces of the package are defined by one side of the blank. Suitable advertising, product identification and UPC code information can be printed on the blank.

The present paperboard blank has a frontal portion which also serves to close the top of the container, a pair of symmetrical side portions joined to the frontal portion by fold lines, a rear portion joined to one of the side portions by a fold line, and a plurality of flap portions, one flap portion being joined to each of the frontal, side and rear portions by fold lines. The flap portions interlock to provide a snap-release closure for the bottom of the container. The upper surfaces of each of the frontal and rear portions define parabolic curves and the upper surfaces the symmetrical side portions are arcuate in configuration conforming to the parabolic curves when the blank is assembled. When viewing the front of the package or container the frontal portion has a vertical lower section and a dome-shaped upper section which is displaced rearwardly towards the rear portion to give an appearance similar to the egg-shaped containers disclosed in U.S. Pat. Nos. 3,741,379 and 3,924,736.

The object of the invention is to provide a new and novel package or carton for articles.

Another object of the invention is the provision of a container prepared from a single blank which has the appearance of a dome-shaped top when viewed from the front.

A further object of the invention is to provide a carton which is simple in construction and inexpensive to manufacture.

Other objects and advantages of the invention will become evident as the description proceeds and from an examination of the accompanying drawings which illustrate one embodiment of the invention.

DETAILED DESCRIPTION OF THE INVENTION

Figure 1:
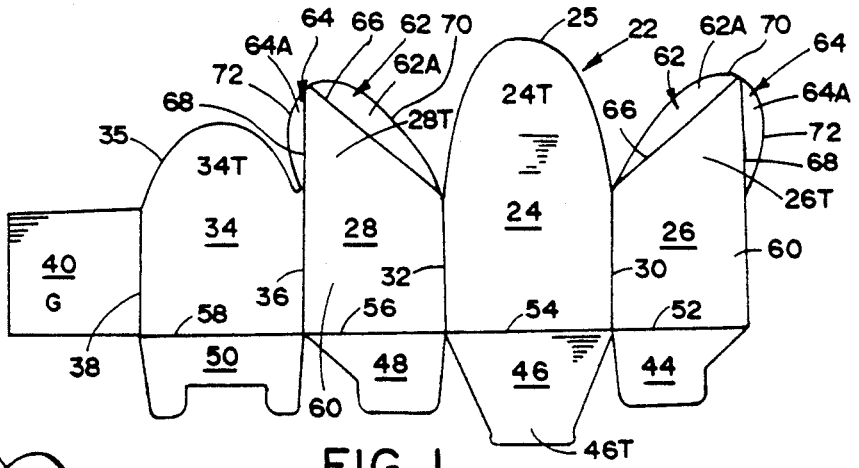
FIG. 1 is a plan view of the blank of the present invention suitably shaped and provided with a plurality of fold lines which may be folded and secured to constitute the carton.
Figure 2:
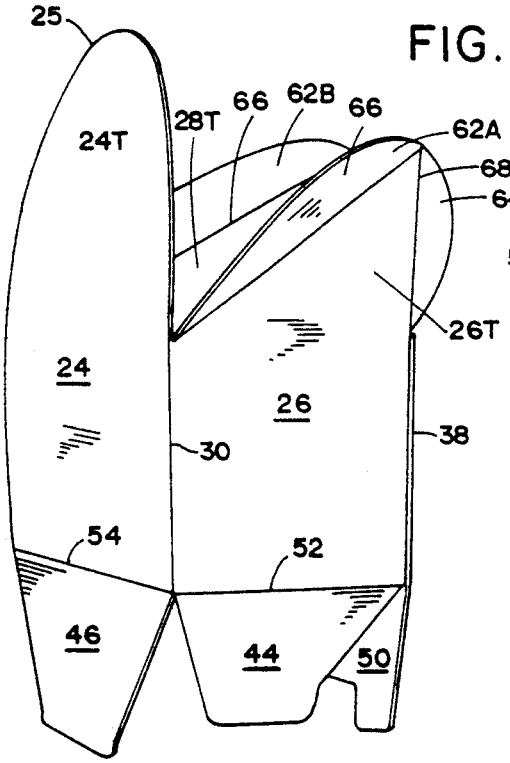
FIG. 2 is a perspective view of the front and side of the partially folded blank.
Figure 3:
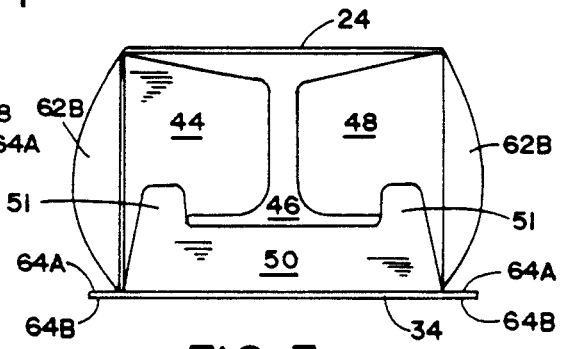
FIG. 3 is a top plan view of the container having the top portion open and illustrating the bottom flaps in a closed position.
Figure 10:
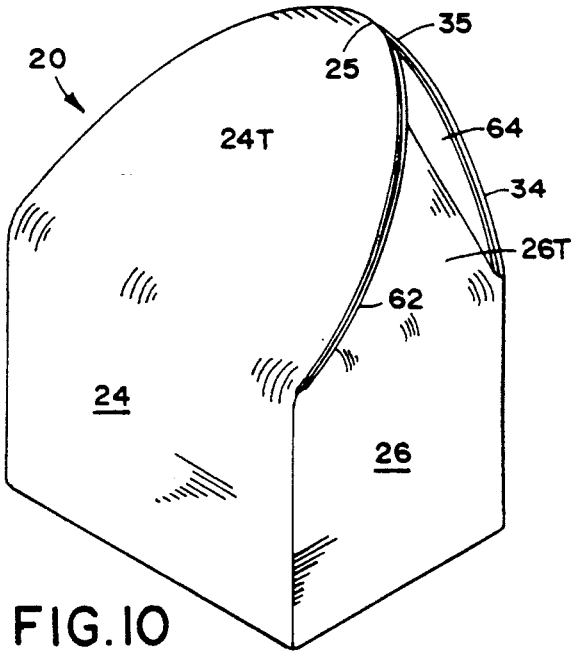
FIG. 10 is a perspective view of the assembled, closed carton.
Figure 11:
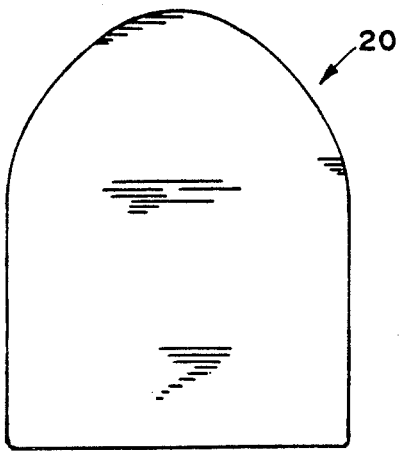
FIG. 11 is a front elevational view of the closed carton.
Figure 12:
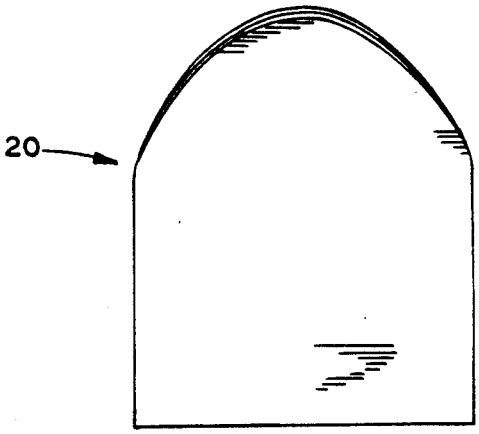
FIG. 12 is a rear elevational view of the closed package.
Figure 13:
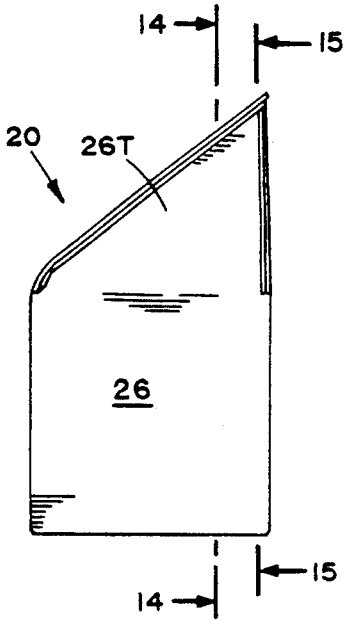
FIG. 13 is an elevational view of one side of the closed carton, the opposite side being a mirror image thereof.

The carton or container 20 of the present invention, as best viewed in FIG. 10 of the drawings is intended for packaging articles, and particularly apparel such as hosiery articles, undergarments, etc. The carton 20 preferably is formed from a single flat sheet of cardboard, paperboard, or other suitable relatively stiff, foldable material in the form of a blank 22 having a shape substantially as depicted in FIG. 1 of the drawings.

The blank 22 may have a more expensive calendered finish on one side, the side to be used as the outer surfaces of the assembled carton. The blank 22 includes a first or frontal panel 24, a pair of symmetrical side panels 26 and 28 each having upper bendable portions 26T and 28T, one at each side of the frontal panel 24 and joined thereto by vertically extending fold lines 30 and 32. The frontal panel 24 serves as the front of the carton and the upper portion 24T is folded or urged rearwardly over the side panels and towards the rear panel and serves to close the top of the carton.

Throughout the specification and claims, the terms "frontal", "rear", and "side" panels and "vertical", "horizontal" and "diagonal" fold lines refer to the carton as assembled and positioned upon a generally horizontal support or slightly inclined support surface of a display, as shown generally by FIGS. 10–13.

A rear panel 34 is joined to the side panel 28 by a vertical fold line 36. A flap or tab 40 is connected to the panel 34 by a fold line 38. This flap 40 may be glued to the inside surface of the side panel 26 during assembly of the carton. Glue G may be applied to the flap 40 as shown by FIG. 1 or glue may be applied to the inner unfinished surface of panel 26 which overlies flap 40. The height of the assembled carton is determined by the length or size of panel 34.

Depending from the panels 26, 24, 28 and 34 are flaps 44, 46, 48 and 50, respectively, connected thereto by horizontal fold lines 52, 54, 56 and 58. The flaps interlock to close the bottom or base of the carton, as will be later described.

The upper portions 24T and 34T of the frontal and rear panels 24 and 34, which extend outwardly beyond the fold lines 30, 32, 36, 38, terminate in curved edges which define parabolic curves, as shown by FIG. 1.

Referring to the symmetrical side panels 26, 28, each has a main portion 60 and two tabs 62 and 64 joined thereto by diagonal and vertical fold lines 66 and 68, respectively, as shown by FIG. 1. The outer or finished surfaces of the tabs 62 and 64 are designated by reference characters 62A and 64A while the inner or unfinished surfaces of the tabs are designated by reference characters 62B and 64B. The outer edge surfaces 70 and 72 of tabs 62,64 define a continuous curved surface when the blank is in the flattened state of FIG. 1. Also, the fold lines 66 and 68 intersect at the juncture of the outer edge surfaces 70 and 72. The curvature of the outer edges of the tabs 64,64 corresponds to the curvature of the uppermost edges 35 of the rear panel 34 defining a parabolic curve, and the curvature of the outer edges of the tabs 62,62 corresponds to the curvature of the uppermost edges 25 of the frontal panel 24.

Figure 14:
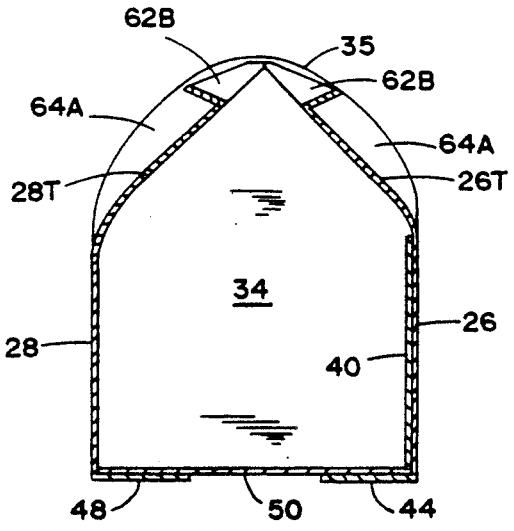
FIG. 14 is a sectional view of the assembled carton taken along line 14—14 of FIG. 13, and with the top of the frontal panel removed.
Figure 15:
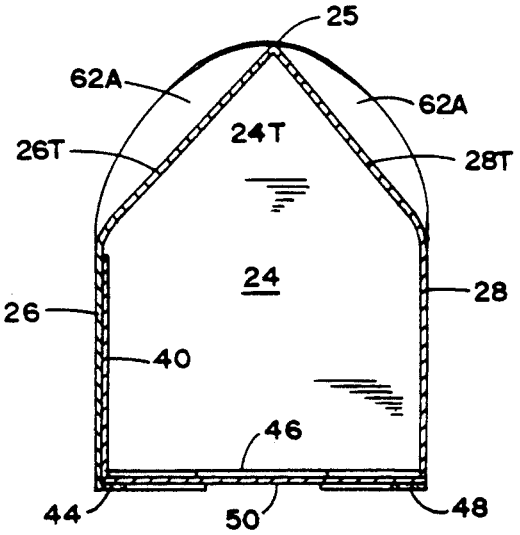
FIG. 15 is a sectional view of the carton taken along line 15—15 of FIG. 13.

In the assembled condition of the carton, the upper portions 26T and 28T of the side panels are bent or curved inwardly towards each other as best shown in FIGS. 10, 14 and 15, the tabs 64 of the two side panels 26,28 are bent along the fold lines 68 so that the surfaces 64B lie flat against the inner surfaces of the rear panel 34 with the curved outer edge surfaces 72 aligned with the edges 35 of panel 34 defining a parabolic curve. The tabs 62 of the two side panels 26,28 are bent along diagonal fold lines 66 such that when the upper portion 24T of the frontal panel is bent rearwardly into substantially abutting relation with the uppermost edges of panel 34, the curvature of the outer edges 70 corresponds to and is aligned with the outer edges 25 of the panel 24 defining a parabolic curve. The surfaces 62B of tabs 62 lie flat against the inner surfaces of the upper portion 24T of panel 24. Glue may be located on surfaces 62B and 64B to secure the tabs 64,62 against the panels 24,34.

Figure 4:
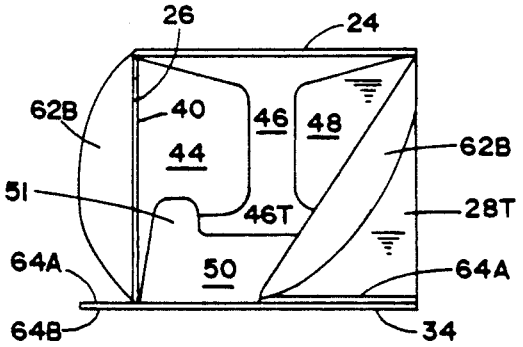
FIG. 4 is a top plan view of the carton illustrating the bottom flaps in a closed position and with the side portions in various stages of assembly.
Figure 5:
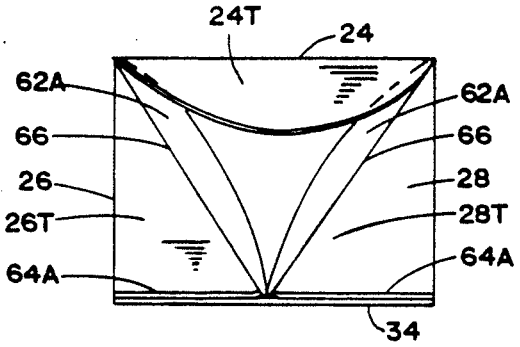
FIG. 5 is a top plan view of the carton with the bottom closure flaps open and unfolded and with the top partially closed.
Figure 6:
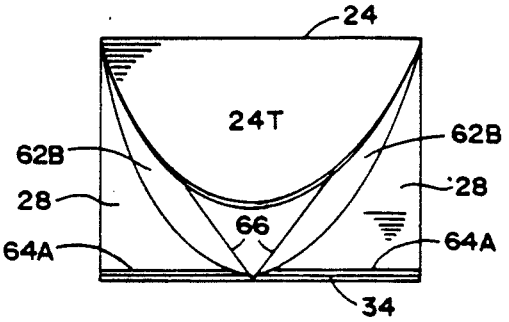
FIG. 6 is a view similar to FIG. 5 and with the top moved to a further partially closed position.
Figure 7:
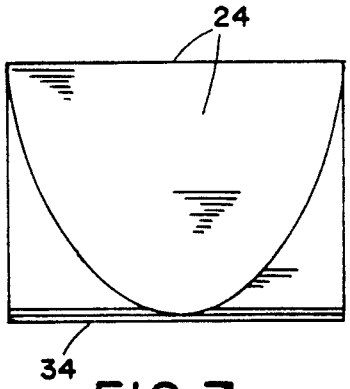
FIG. 7 is a top plan view of the closed carton.
Figure 8:
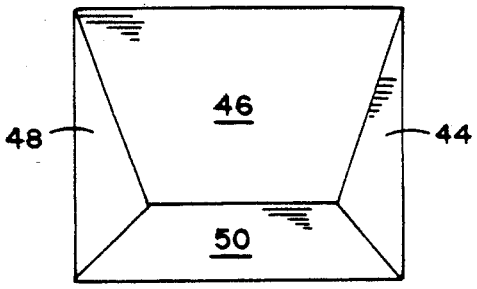
FIG. 8 is a plan view of the bottom of the carton illustrating the bottom flaps in the closed positions.
Figure 9:
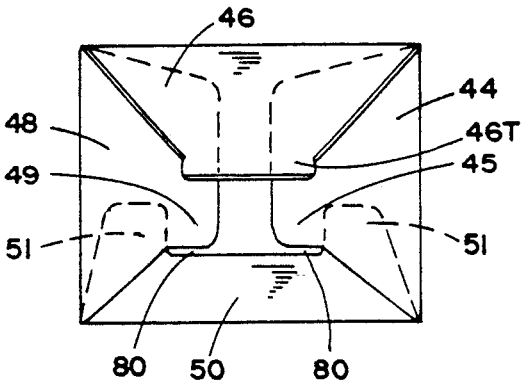
FIG. 9 is a bottom plan view of the carton prior to interlocking of the bottom closure flaps.

In FIG. 4, the right side shows the top portion 28T of panel 28 curved inwardly and with the tab 64 secured to the rear panel 34 and with the tab 62 being folded for engagement with inner surfaces of the panel top portion 24T. The left side of FIG. 4 shows the upper portion 26T of panel 26 extending vertically before being bent or curved inwardly and with the tabs 62 and 64 being bent along fold lines 66 and 68, respectively, such that they are approximately at right angles with respect to the panel 26.

The bottom of the carton is closed by the flaps 44, 46, 48 and 50 which are selectively configured to interlock but which may readily snap open to provide access to the carton. The flap 50 is bent inwardly along fold line 58, followed by the two flaps 48,44 being bent inwardly along lines 56 and 52, respectively. The remaining flap 46 is folded inwardly along line 54 with the tongue portion 46T being inserted inwardly into a slot 80 to interlock the four flaps. The slot 80 is defined by the tabs 61 of flap 50 and the tabs 45 and 49 of the flaps 44,48. Ready access to an article or articles within the carton is provided by merely depressing or pressing inwardly the central portion of the flap 50 to disengage the tongue portion 46T from the slot 80. If it is necessary that the bottom closure flaps be positively locked together, glue or adhesive may be selectively applied between the various flaps.

It should be understood that modifications can be resorted to without departing from the spirit hereof and the scope of the appended claims.

What is claimed is:

1. A carton for packaging apparel comprising a rear panel, a pair of substantially symmetrical side panels connected to said rear panel, each of said side panels including a first vertically extending portion and a second portion curved inwardly, a frontal panel having a first vertically extending portion and a second upper portion extending rearwardly towards the top of said rear panel for closing the top of the carton, each of said side panel second portions including a pair of tabs for securing said side panels to said rear panel and said side panels to said frontal panel, and flap means for closing the bottom of said carton.

2. A carton as recited in claim 1, wherein the upper edges of each of said frontal panel and said rear panel defines a parabolic curve.

3. A carton as recited in claim 2, wherein the outer edges of the tabs of said side panels conform in curvature to portions of said frontal and rear panel outer edges defining parabolic curves.

4. A folded, one-piece, snap-open carton for packaging articles, said carton including rear, side and frontal panels interconnected by vertical fold lines, each of said rear, side and frontal panels having portions extending upwardly above said fold lines, said upwardly extending portions of said side panels being secured to upwardly extending portions of said rear panel, and said upwardly extending portions of said frontal panel extending rearwardly towards said rear panel to close the top of said carton and secured to said upwardly extending portions of said side panels, and a plurality of interlocking flaps connected to said frontal, side and rear panels along horizontal fold lines for closing the bottom of said carton.

5. A carton as recited in claim 4, wherein said upwardly extending portions of each of said rear and frontal panels terminates in edge surfaces defining a parabolic curve.

6. A carton as recited in claim 5, wherein each of the upwardly extending portions of said side panels includes a diagonal fold line having a first tab secured thereto and a vertical fold line having a second tab secured thereto, said first tab being secured to said frontal panel and second tab secured to said rear panel.

7. A carton as recited in claim 6, wherein said first tab has edge portions defining a curve which corresponds to portions of said frontal panel edges defining a parabolic curve.

8. A carton as recited in claim 7, wherein said second tab has edge portions defining a curve which corresponds to portions of said rear panel edges defining a parabolic curve.

9. A carton as recited in claim 4, one flap of each of said plurality of flaps defining said bottom closure being connected to each of said frontal, rear and side panels by fold lines and defining an interlocking, readily releasable closure for providing ready access to the carton interior, said releasable closure being readily opened by pressing inwardly of the carton a selected one of said plurality of flaps.

10. A unitary one-piece blank of flexible, relatively stiff sheet material which may be folded to constitute a container for apparel comprising a frontal panel joined to first and second symmetrical side panels by vertically extending fold lines, a rear panel joined to one of said first and second side panels by a vertically extending score line, the upper portions of each of said frontal, rear and side panels terminating in curved edges, said upper portion of each of said side panels including a first tab and a second tab, said first tab having an outer edge, curvature conforming to the curvature of the curved edges of a section of the frontal panel upper portion, said second tab having an outer edge curvature conforming to the curved edges of a section of the rear panel upper portion.

11. A one-piece blank as recited in claim 10 wherein said curved edges of the upper portion of each of said frontal and rear panels defines a parabolic curve.

12. A one-piece blank as recited in claim 11 wherein the height of said frontal panel is substantially greater than the height of said rear panel.

13. A one-piece blank as recited in claim 10, and further including a plurality of flaps, one flap depending from each of said frontal, rear and side panels.

14. A unitary, one-piece blank which may be folded to constitute a container including a frontal panel, first and second side panels joined to each side of said frontal panel by vertically extending fold lines, a rear panel joined to one of said first and second side panels by a vertically extending fold line, said frontal panel having upper distal edges defining a parabolic curve, said rear panel having upper distal edges defining a parabolic curve, each of said first and second side panels including a main section and first and second fold tabs joined to said main section by fold lines, said first fold tabs having curved outer edge portions conforming in configuration to the parabolic curve upper distal edges of said frontal panel, said second fold tabs having curved outer edge portions conforming in configuration to the parabolic curve upper distal edges of said rear panel.

* * * * *